US006923148B2

(12) United States Patent
Lesage

(10) Patent No.: US 6,923,148 B2
(45) Date of Patent: Aug. 2, 2005

(54) COMBUSTION CHAMBER WITH HIGH TEMPERATURE PROTECTIVE COATING

(75) Inventor: Claude Lesage, Pointe Claire (CA)

(73) Assignee: Giant Factories Inc., Montreal (CA)

( * ) Notice: Subject to any disclaimer, the term of this patent is extended or adjusted under 35 U.S.C. 154(b) by 0 days.

(21) Appl. No.: 10/947,153

(22) Filed: Sep. 23, 2004

(65) Prior Publication Data

US 2005/0066913 A1 Mar. 31, 2005

(30) Foreign Application Priority Data

Sep. 25, 2003 (CA) ..... 2442450

(51) Int. Cl.[7] ..... F22B 5/04
(52) U.S. Cl. ..... 122/13.01; 122/17.1; 122/18.1
(58) Field of Search ..... 122/13.01, 17.1, 122/18.1, 18.3, 13.3, 14.1, 15.1, 19.2

(56) References Cited

U.S. PATENT DOCUMENTS 6,202,935 B1 * 3/2001 Akkala et al. ..... 237/19
6,418,884 B1 * 7/2002 Rucker ..... 122/504
6,698,385 B1 * 3/2004 Lesage ..... 122/13.01
6,725,811 B1 * 4/2004 Moore et al. ..... 122/13.01

* cited by examiner

*Primary Examiner*—Gregory Wilson
(74) *Attorney, Agent, or Firm*—Ogilvy Renault LLP; Guy J. Houle

(57) ABSTRACT

A combustion chamber for a gas-fired hot water heater comprises a top wall which is defined by a bottom wall of an inner tank. A flue extends through the inner tank bottom wall. A circumferential skirt is disposed about the combustion chamber. The combustion chamber is supported elevated from a support surface by a bottom pan assembly of a hot water heater housing. A combustion air inlet means leads to the combustion chamber. A floor shield is supported above the bottom wall and spaced below a gas burner assembly. The circumferential skirt and/or the floor shield are coated on at least one surface thereof with refractory paint to reflect radiant heat inwardly in the combustion chamber whereby to maximize heat transferred to the inner tank and to minimize heat loss through the skirt and floor shield.

4 Claims, 1 Drawing Sheet

COMBUSTION CHAMBER WITH HIGH TEMPERATURE PROTECTIVE COATING

TECHNICAL FIELD

The present invention relates to a combustion chamber for a gas-fired hot water heater and wherein the circumferential wall and the bottom wall of a combustion chamber are provided with a high temperature protective coating.

BACKGROUND ART

Combustion chambers of gas-fired hot water heaters are constructed below the bottom wall of the inner tank which contains water to be heated. A flue normally extends centrally in the inner tank from the bottom wall. The combustion chamber if formed by a circumferential skirt or wall disposed below the lower tank and a bottom wall which is elevated from a floor support surface of the hot water heater by a bottom pan. The side walls and bottom wall of the combustion chamber are usually constructed from hot or cold rolled steel which is very thin. This steel is usually treated to remove scales and often this steel is not of uniform thickness. Due to the poor quality of this steel and the thickness thereof, there is excessive heat loss through the side wall and bottom wall of the combustion chamber and this reduces the efficiency of the hot water heater.

SUMMARY OF INVENTION

It is a feature of the present invention to provide a combustion chamber which overcomes the above-mentioned disadvantages of the prior art.

According to a broad aspect of the present invention, there is provided a combustion chamber for a gas-fired hot water heater which comprises a top wall which is defined by a bottom wall of an inner tank. A flue extends through the inner tank bottom wall. A circumferential skirt is disposed about the combustion chamber. The combustion chamber is supported elevated from a support surface by a bottom pan assembly of a hot water heater housing. A combustion air inlet means leads to the combustion chamber. A floor shield is supported above the bottom wall and spaced below a gas burner assembly. The circumferential skirt and/or the floor shield are coated on at least one surface thereof with refractory paint to reflect radiant heat inwardly in the combustion chamber whereby to maximize heat transferred to the inner tank and to minimize heat loss through the skirt and floor shield.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
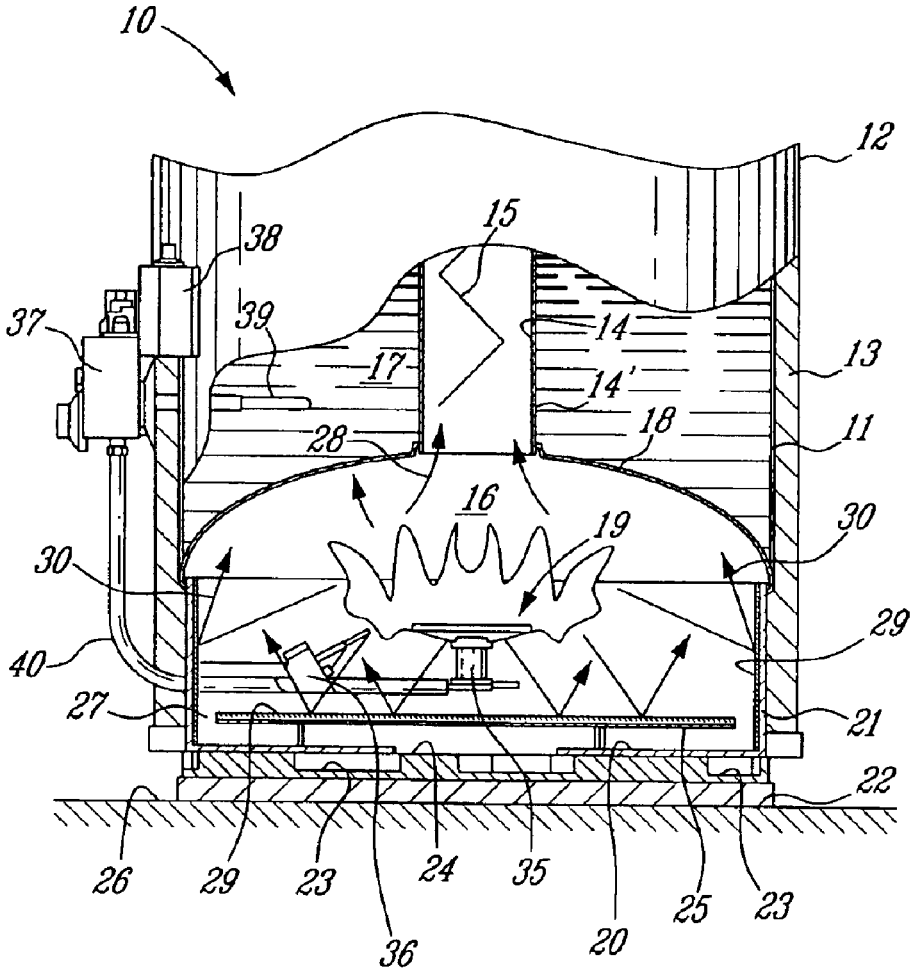
FIG. 1 is a transverse, partly fragmented and partly sectioned view showing the combustion chamber of the present invention.

Referring now to the drawings and more particularly to FIG. 1 there is shown generally at 10 a lower portion of a gas-fired hot water heater. The hot water heater has an inner tank 11 and an outer casing 12 spaced therefrom to define an insulating space 13 in which an insulating foam material is injected. The inner tank 11 has a central flue 14 provided with a baffle 15 and through which hot exhaust fumes from the combustion chamber 16 are convected. The water 17 in the inner tank 11 is heated by heat transfer through its bottom wall 18 and through the sidewall 14' of the flue 14.

The combustion chamber is provided with a burner assembly 19 which is supported elevated from a bottom wall 20 of the combustion chamber. The skirt or side wall 21 of the combustion chamber is formed by a steel cylinder which is very thin and which is hot or cold rolled. Similarly the bottom wall 20 is formed of such steel. The bottom wall 20 is supported elevated by a bottom pan assembly 22 and air openings 23 are provided about the pan whereby to admit ambient air into the inlet opening 24 formed in the bottom wall 20 to provide combustion air to the burner assembly 19. Of course, the combustion chamber may be fed combustible air through other means such as a snorkel pipe (not shown) disposed vertically along the hot water heater and extending through the side wall 21 of the combustion chamber.

As herein shown, a floor shield 25 is supported elevated above the air opening 24 whereby to protect the floor 26 from radiant heat from the combustion chamber. The floor shield 25 is spaced from the side wall 21 whereby to provide a circumferential channel 27 so that combustible air can enter into the combustion chamber 16. The convection flow caused by the hot combustible products exiting into the flue 14, as indicated by arrow 28, and provides a suction into the combustion chamber to draw air thereinto through the air inlet openings 23.

Figure 2:
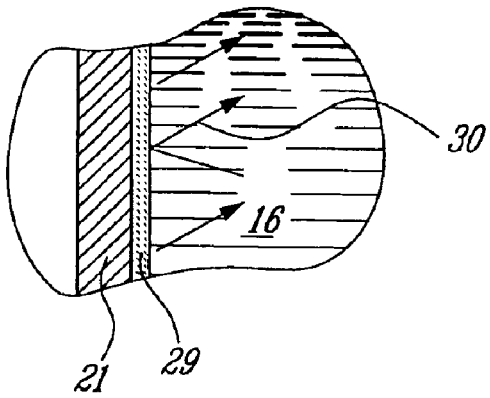
FIG. 2 is an enlarged, cross section view through the circumferential side wall or floor shield of the hot water heater showing the coating in a surface of the steel plate.

With additional reference now to FIG. 2, and in order to enhance the efficiency of the combustion chamber, the circumferential skirt or sidewall 21 and/or the floor shield 25 are coated, on at least one of two surfaces thereof, with a refractory paint 29 whereby to reflect radiant heat inwardly in the combustion chamber as indicated by arrows 30 to maximize heat transfer to the inner tank towards its bottom wall and to minimize heat loss through the skirt and floor shield. As shown in FIG. 2 the coating is on the inside surface facing the combustion chamber 16. This refractory paint can be a ceramic adhesive coating such as the coating #840-M sold by Aremco Products Inc. or a ceramic additive such as that provided by Hy-Tech Thermal Solutions. Of course, other types of heat resistant ceramic or reflective coatings may serve the purpose.

Another advantage of coating the side wall and bottom wall as well as the floor shield of the combustion chamber with such high temperature protective coatings is to extend the life of the combustion chamber as these metal parts are usually formed from very thin gauge steel plates and because of their non-uniform thickness some of these can deteriorate quite quickly. They should have a life span which as least extends that of the gas-water heater and it is usually recommended that these be changed every 9–10 years.

Although not part of the present invention, FIG. 1 illustrates component parts associated with the burner assembly 19 and namely a gas burner 35, a pilot ignition device 36, a gas control device 37 and a spark ignition system 38. A temperature sensor 39 extends inside the inner tank to sense the temperature therein and a control device controls the supply of gas through the supply line 40 to the gas burner 35.

It is within the ambit of the present invention to cover any obvious modifications of the preferred embodiment described herein, provided such modifications fall within the scope of the appended claims.

I claim:

1. A combustion chamber for a gas-fired hot water heater, said combustion chamber having a top wall defined by a bottom wall of an inner tank, a flue extending through said inner tank bottom wall, a circumferential skirt about said combustion chamber, said combustion chamber being supported elevated from a support surface by a bottom pan assembly of a hot water heater housing, a combustion air inlet means leading to said combustion chamber, and a floor shield supported above said bottom wall and spaced below a gas burner assembly; said circumferential skirt and/or said floor shield being coated, on at least one surface thereof, with refractory paint to reflect radiant heat inwardly in said combustion chamber to maximize heat transfer to said inner tank and to minimize heat loss through said circumferential skirt and floor shield.

2. A combustion chamber as claimed in claim 1 wherein said refractory paint is coated on an inner surface of said circumferential skirt and floor shield.

3. A combustion chamber as claimed in claim 2 wherein said refractory paint is a ceramic adhesive coating.

4. A combustion chamber as claimed in claim 2 wherein said refractory paint has a ceramic additive therein.

* * * * *